US010724733B1

(12) United States Patent
Backe

(10) Patent No.: US 10,724,733 B1
(45) Date of Patent: Jul. 28, 2020

(54) SAFETY LIGHTING SYSTEM FOR USE WITH POWER TOOLS AND EQUIPMENT

(71) Applicant: Michael Backe, Valdosta, GA (US)

(72) Inventor: Michael Backe, Valdosta, GA (US)

( * ) Notice: Subject to any disclaimer, the term of this patent is extended or adjusted under 35 U.S.C. 154(b) by 0 days.

(21) Appl. No.: 16/662,138

(22) Filed: Oct. 24, 2019

(51) Int. Cl.

| | |
|---|---|
| ***F21V 33/00*** | (2006.01) |
| ***A41D 13/01*** | (2006.01) |
| ***F21V 23/06*** | (2006.01) |
| ***F21W 111/10*** | (2006.01) |
| ***F21V 23/02*** | (2006.01) |

(52) U.S. Cl.
CPC ..... *F21V 33/0076* (2013.01); *A41D 13/01* (2013.01); *F21V 23/06* (2013.01); *F21V 33/0008* (2013.01); *F21V 33/0084* (2013.01); *F21V 23/02* (2013.01); *F21W 2111/10* (2013.01)

(58) Field of Classification Search
CPC ..... F21V 33/0088; F21V 33/008; F21V 33/0008; B25B 23/18; B26B 11/008
USPC ..... 362/119, 120, 102, 109
See application file for complete search history.

(56) References Cited

U.S. PATENT DOCUMENTS

| | | | | |
|---|---|---|---|---|
| 8,408,731 | B1 * | 4/2013 | Joyner | A41D 1/04 2/102 |
| 2004/0125596 | A1 * | 7/2004 | Brooks | B23D 59/00 362/119 |
| 2006/0028819 | A1 * | 2/2006 | Shankland | B25H 3/06 362/253 |
| 2006/0176681 | A1 * | 8/2006 | Krimmer | F21L 4/027 362/108 |
| 2007/0193039 | A1 * | 8/2007 | Onose | B27B 9/00 30/388 |
| 2008/0043458 | A1 * | 2/2008 | Desjardin | G08B 5/004 362/108 |
| 2010/0315804 | A1 * | 12/2010 | Nishikimi | B25F 5/021 362/119 |
| 2016/0131353 | A1 * | 5/2016 | Bartoszek | B25F 5/021 362/119 |

* cited by examiner

*Primary Examiner* — William N Harris
(74) *Attorney, Agent, or Firm* — Larson & Larson, P.A.; Justin P. Miller; Frank Liebenow

(57) ABSTRACT

The safety lighting system solves the problem of working in low-visibility situations by providing enhanced 360-degree visibility of a worker and his equipment to passing vehicles and pedestrians. The safety lighting system works in combination with a piece of maintenance equipment, a power tool, a battery pack, or a maintenance backpack. The safety lighting system illuminates the operator, the tool, and a surrounding area when the tool or piece of equipment is in use. Such a system allows a passerby to see the operator even in substandard light conditions.

5 Claims, 8 Drawing Sheets

SAFETY LIGHTING SYSTEM FOR USE WITH POWER TOOLS AND EQUIPMENT

FIELD

This invention relates to the field of outdoor maintenance equipment and more particularly to a lighted vest for illuminating an operator, a tool, and a surrounding area to provide increased visibility of the operator for safety purposes.

BACKGROUND

Each year, millions of hand-held outdoor power tools are operated in close proximity to other workers, motorists, and pedestrians.

Outdoor maintenance is often performed in a variety of conditions including during the day, evening, outside construction sites, in tight spaces near cars and pedestrians, or in other areas that are not well-lit. In these conditions, pedestrians or cars approaching or passing by will have difficulty seeing the operator.

Compounding the problem of visibility of the operator is the fact that the handheld devices reduce visibility in the area where they are used by emitting exhaust or stirring up dust. This combination of multiple dangerous conditions makes many outdoor maintenance jobs unsafe.

What is needed is a safety lighting system for use with maintenance equipment.

SUMMARY

The safety lighting system solves the problem of working in low-visibility situations by providing enhanced 360-degree visibility of a worker and his equipment to passing vehicles and pedestrians.

The safety lighting system works in combination with a piece of maintenance equipment, a power tool, a battery pack, or a maintenance backpack. The safety lighting system illuminates the operator, the tool, and a surrounding area when the tool or piece of equipment is in use. Such a system allows a passerby to see the operator even in substandard light conditions.

Associated tools include edgers, line trimmers, brush cutters, bed refiners, pole saws, pruners, chain saws, hedge trimmers, shredder vacuums, concrete cutters, blowers, sprayers, and hand-held power tools. These tools may be battery powered, powered by cords to electrical outlets, or gas powered. The safety lighting system works with tools of any power type by drawing power for the lights from the power source of the piece of equipment.

The safety lighting system includes a plurality of lights built into the piece of equipment, built into the power tool, added to the power tool, or incorporated into a vest the operator wears. Preferably the lighting system creates lighting in all directions—360 degrees around the user.

The location of the built-in lights depends on the piece of equipment or power tool. For example, lights should be located on the rear and on each side of each piece of equipment. But certain pieces of equipment or tools, such as edgers and tree trimmers, preferably include a built-in light away from the body of the tool instead closing to the working end. This is necessary because these pieces of equipment operate further away from the user's body, with the hazard arising away from the user's body. For example, the rotating head of a string trimmer. Adding lighting at the end, where the hazard to a third-party exists, is important to warn the third-party of potential harm.

The vest includes a plurality of lights. Preferred lighting locations include the chest, the back, and each shoulder. Lights on all sides of the vest enhance the visibility of the operator in all directions.

In one embodiment of the lighted safety vest, the lights placed at each location are individual lights. In alternative embodiments, the vest includes a series of lights, or strips of lights, running from the back, over the shoulders, and down the torso.

The lighted vest is electrically connected to the power tool or piece of equipment. This allows the lights to be powered by the tool and not require a separate power source to be located on the vest. In order to connect to the tool, the lighted vest includes a cord with a male connector. The power tool or piece of equipment includes a female outlet or port into which the vest cord will plug to draw power.

On gas powered tools, the tool will require an alternator to convert the gas power to electrical power for operation of the lighting.

Another problem that can occur when using power tools or pieces of equipment is the tool being dropped or thrown from the users grip during use. In the event of the user losing control of the tool, the vest cord will automatically disengage from the power tool or piece of equipment. When the vest cord disengages from the power tool, the tool will shut off. Thus, the out of control tool stop running, reducing the hazard.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
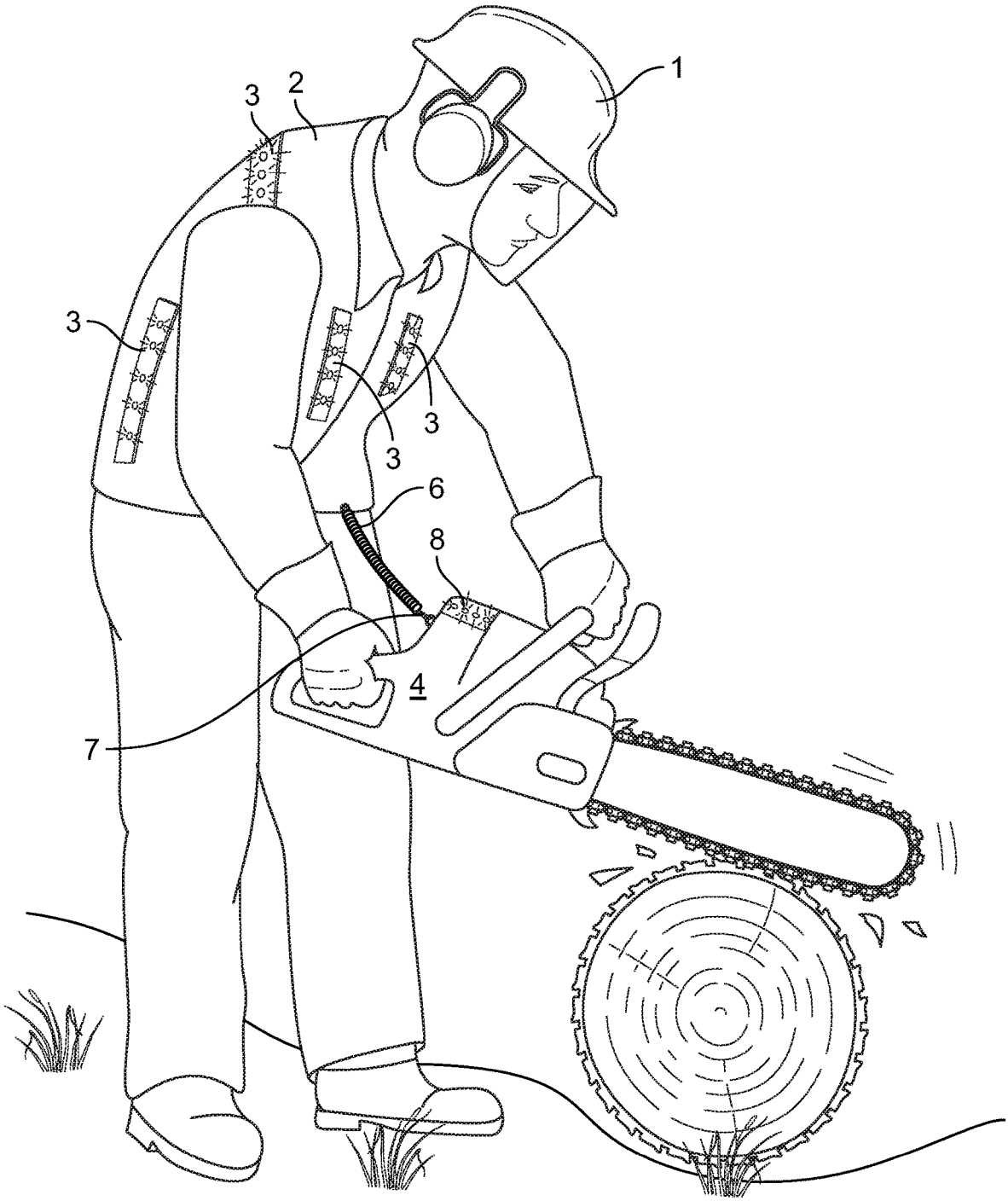
FIG. 1 illustrates a lighted safety vest in use with a chainsaw.

Reference will now be made in detail to the presently preferred embodiments of the invention, examples of which are illustrated in the accompanying drawings. Throughout the following detailed description, the same reference numerals refer to the same elements in all figures.

Referring to FIG. 1, the lighted safety vest is shown in use with a chainsaw. The safety vest 2 includes lights 3 that illuminate the worker 1 and piece of equipment 4 when the equipment is running.

The safety vest 2 is electrically connected to the piece of equipment 4 by a cord 6. The cord terminates in a plug 7 that inserts into a piece of equipment 4 via a port 10/12 (see FIG. 6).

When the plug 7 is inserted into the port 10/12, it completes a circuit that allows the worker 1 to start the piece of equipment 4. The piece of equipment 4 will not start unless the plug 7 is connected. Suitable plug and port types are USB, mini-phono, two-prong, three-prong, butt connector, or other suitable electrical connectors.

In addition to the lighted safety vest 2, the piece of equipment also includes safety lights 8. The combination of the lighted safety vest and the safety lights provides 360 degrees of illumination.

Figure 2:
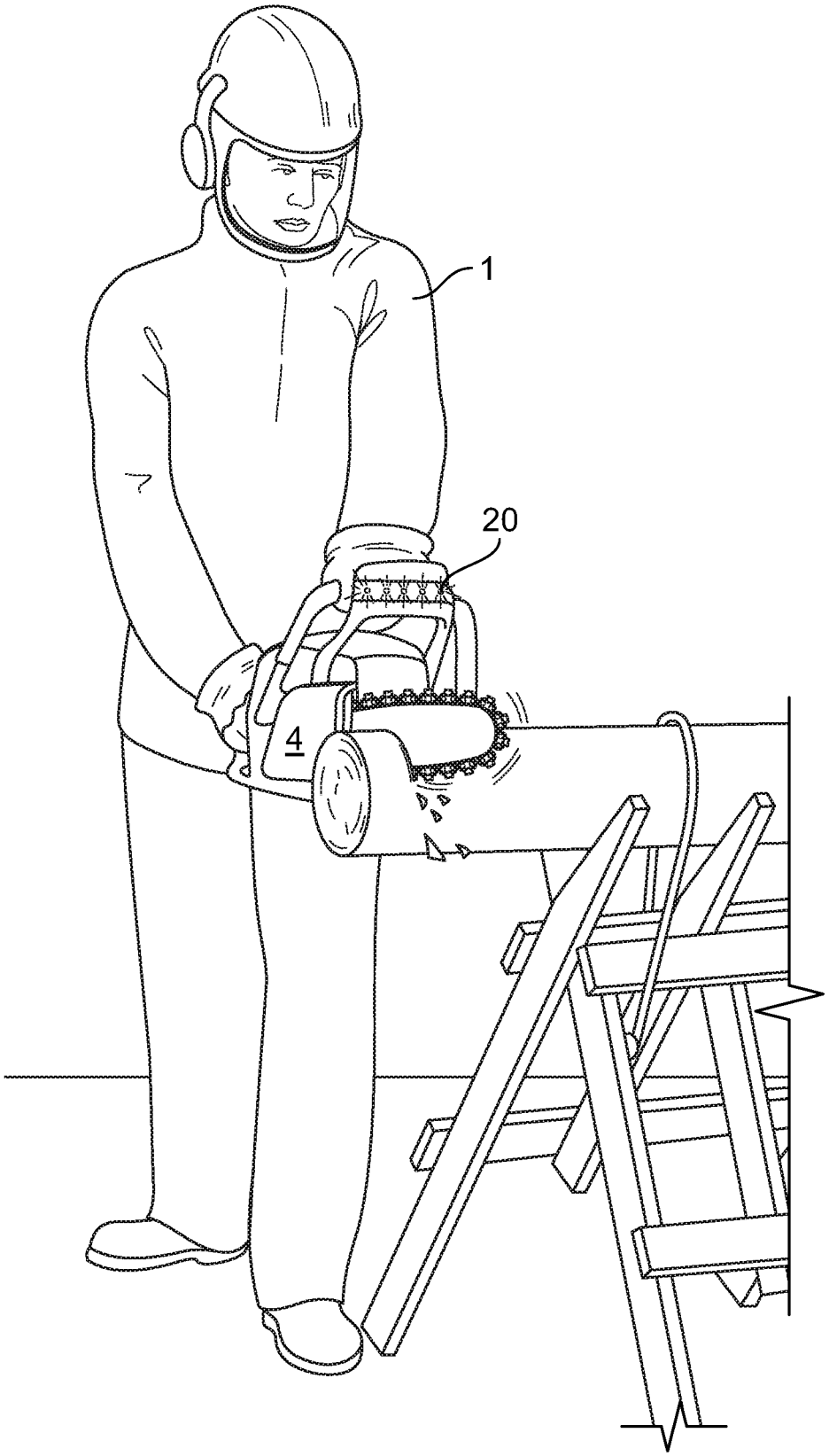
FIG. 2 illustrates a front view of a chainsaw with built-in lighting elements.

Referring to FIG. 2, a front view of a chainsaw with built-in lights is shown. The safety light 8 on the forward handle of the chainsaw 4 provides increases visibility with or without the vest 2 (not shown). This forward-placed light 20 is best coupled with the rear light 8 (see FIG. 1), thus illuminating 360 degrees around the chainsaw 4. Third-parties can then easily see the boundaries of the piece of equipment 4 from a safe distance and be able to avoid passing too close to the tool 4 or worker 1.

Figure 3:
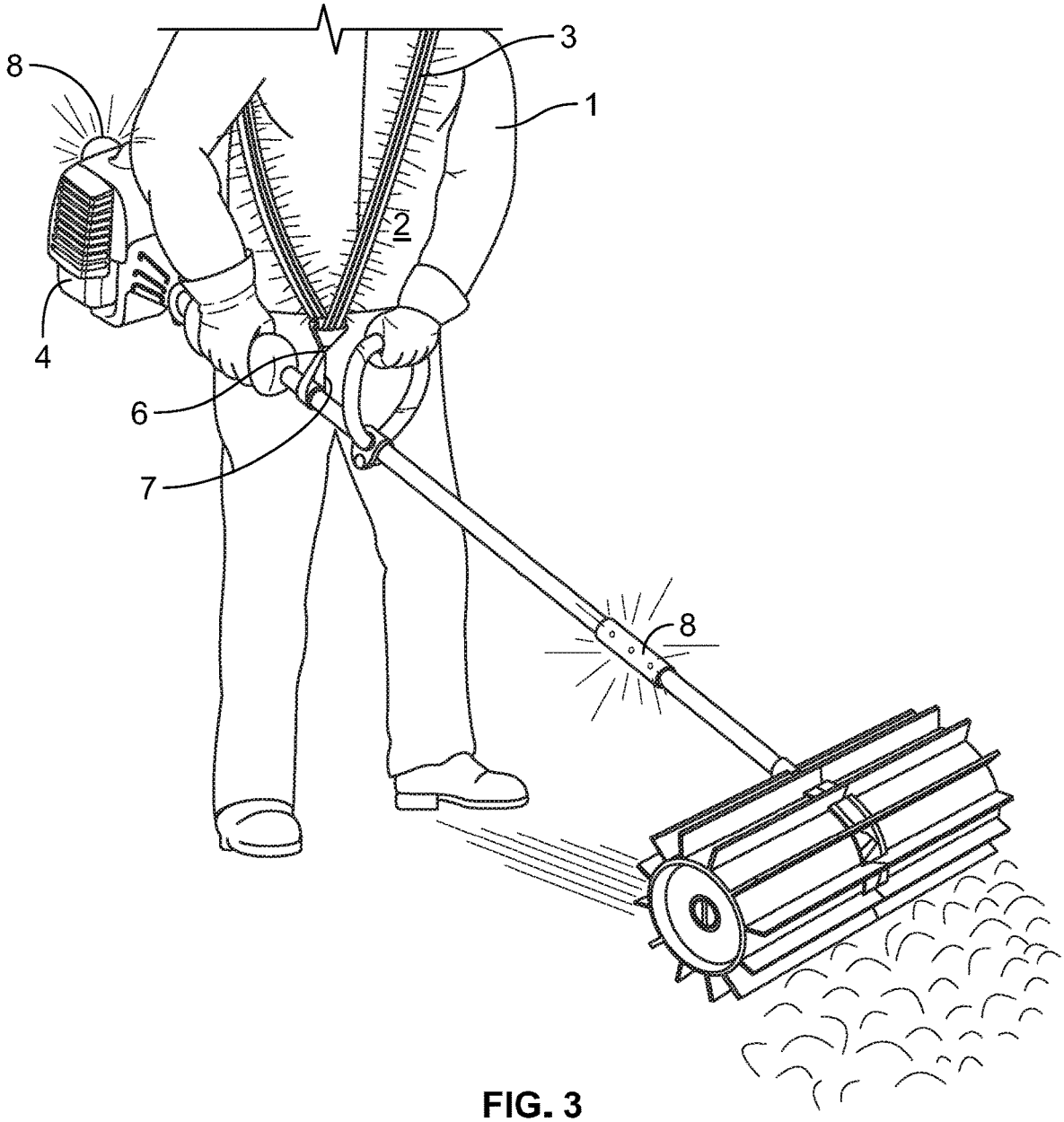
FIG. 3 a lighted safety vest in use with a piece of yard equipment.

Referring to FIG. 3, a second embodiment of the lighted safety vest is shown. In this embodiment, the lighted safety vest 2 is a thin piece of material, akin to a strap or support strap, that hangs across the shoulder and torso of a user. This embodiment of the lighted safety vest 2 includes lights 3, and connects to the piece of equipment 4 via a power cord 6, connecting at plug 7. Again shown are safety lights 8.

Figure 4:
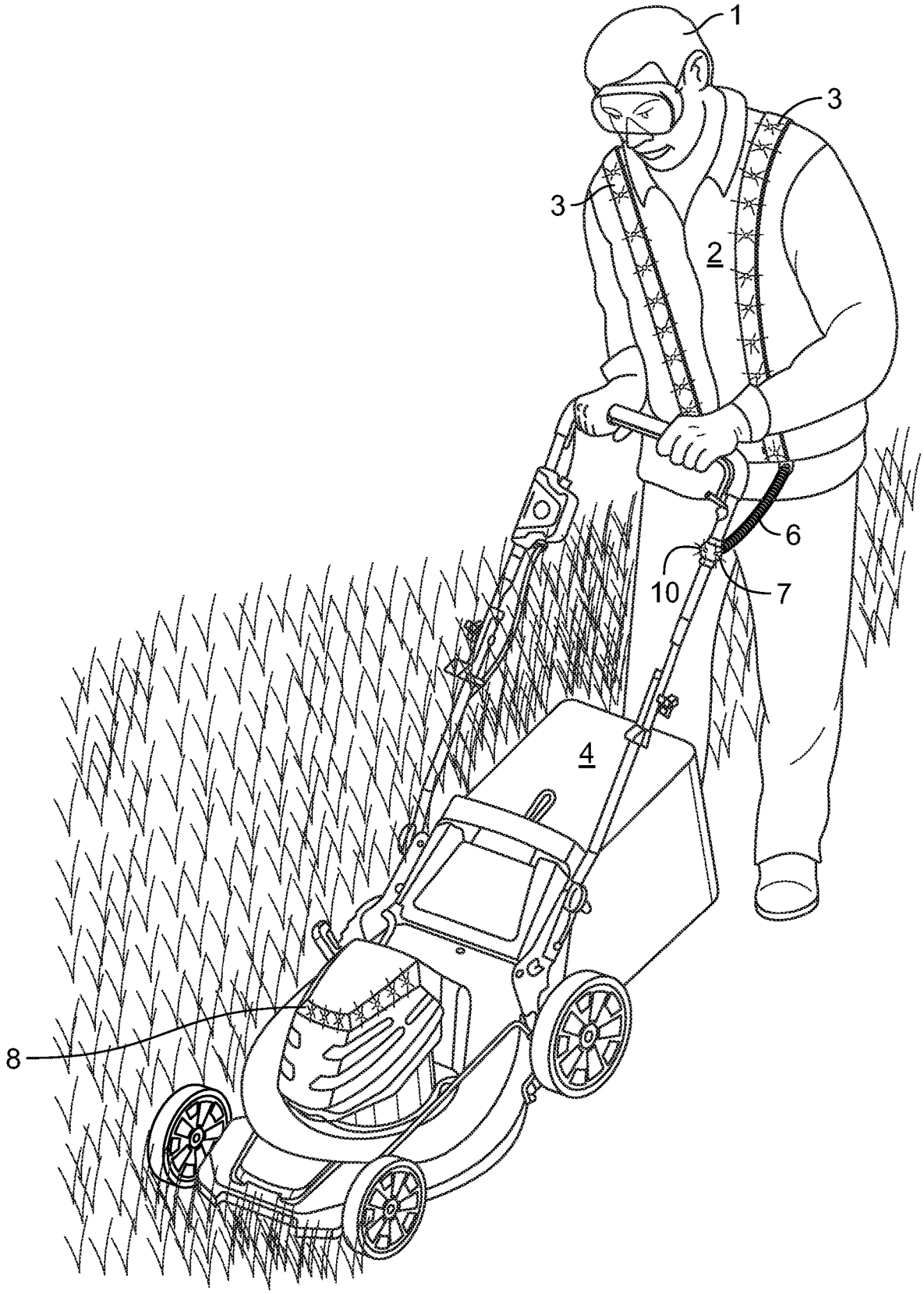
FIG. 4 illustrates a lighted safety vest for use with a lawn mower.

Referring to FIG. 4, the safety vest 2 with lights 3 for use with a lawn mower 4 is shown. When using the lighted safety vest 2 with a compatible lawn mower 4, the port 10/12 is located near the handle such that the cord 6 will reach the piece of equipment 4 to draw power through plug 7. Safety lights 8 are shown on a visit part of the lawn mower 4, here the engine/motor housing.

Figure 5:
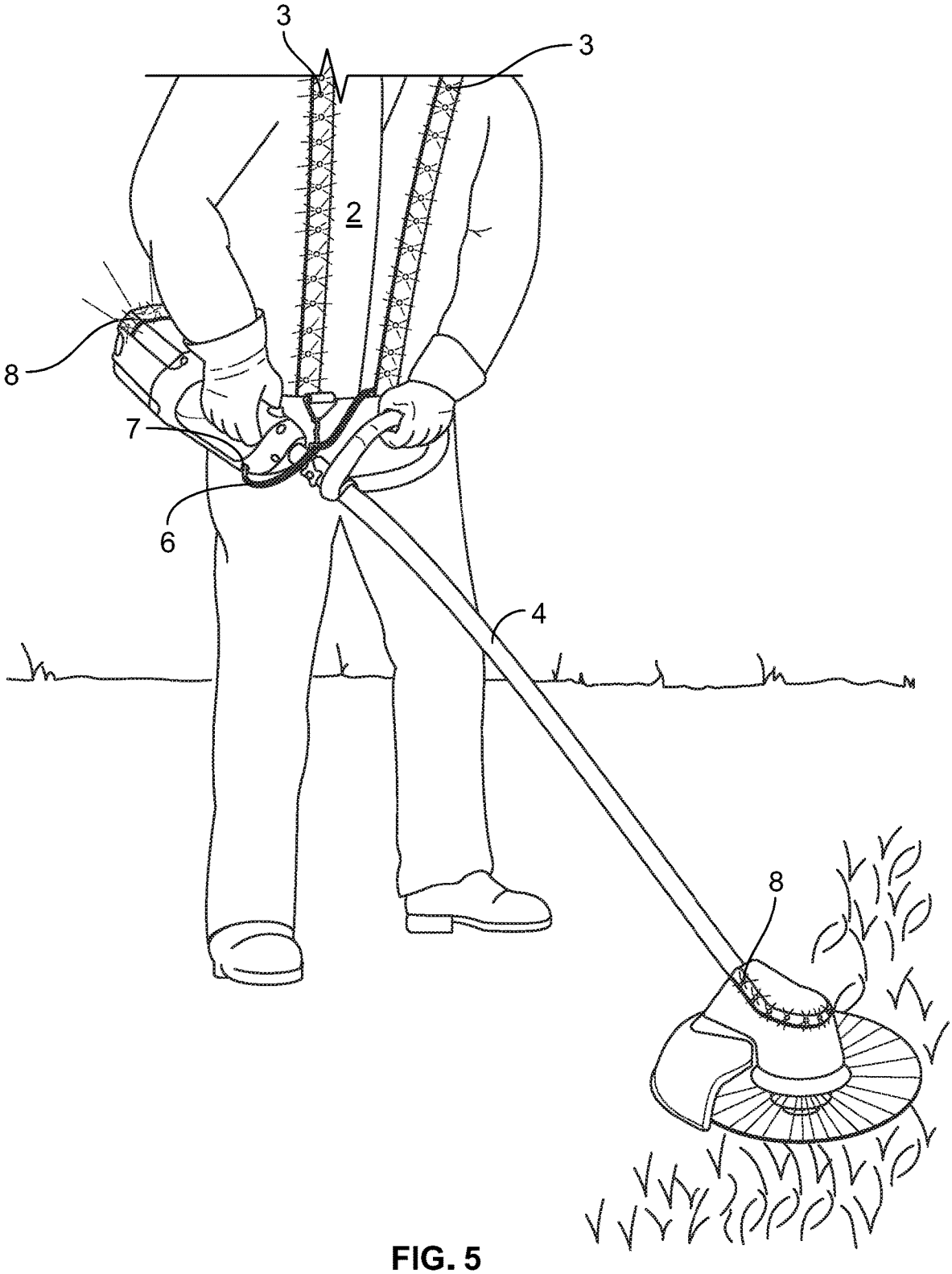
FIG. 5 illustrates a lighted safety vest for use with a weed whacker.

Referring to FIG. 5, the lighted safety vest is shown in use with a string trimmer. The location of the port 10/12 will vary depending on the type of equipment. The port 10/12 (see FIG. 6) is preferably located on the piece of equipment 4 near the user 1. If the port 10/12 is too far away from the user 1, the length of the cord 6 will create an additional hazard. Safety lights 8 are visible on the housing of the string trimmer 4, near where the hazard is greatest.

Figure 6:
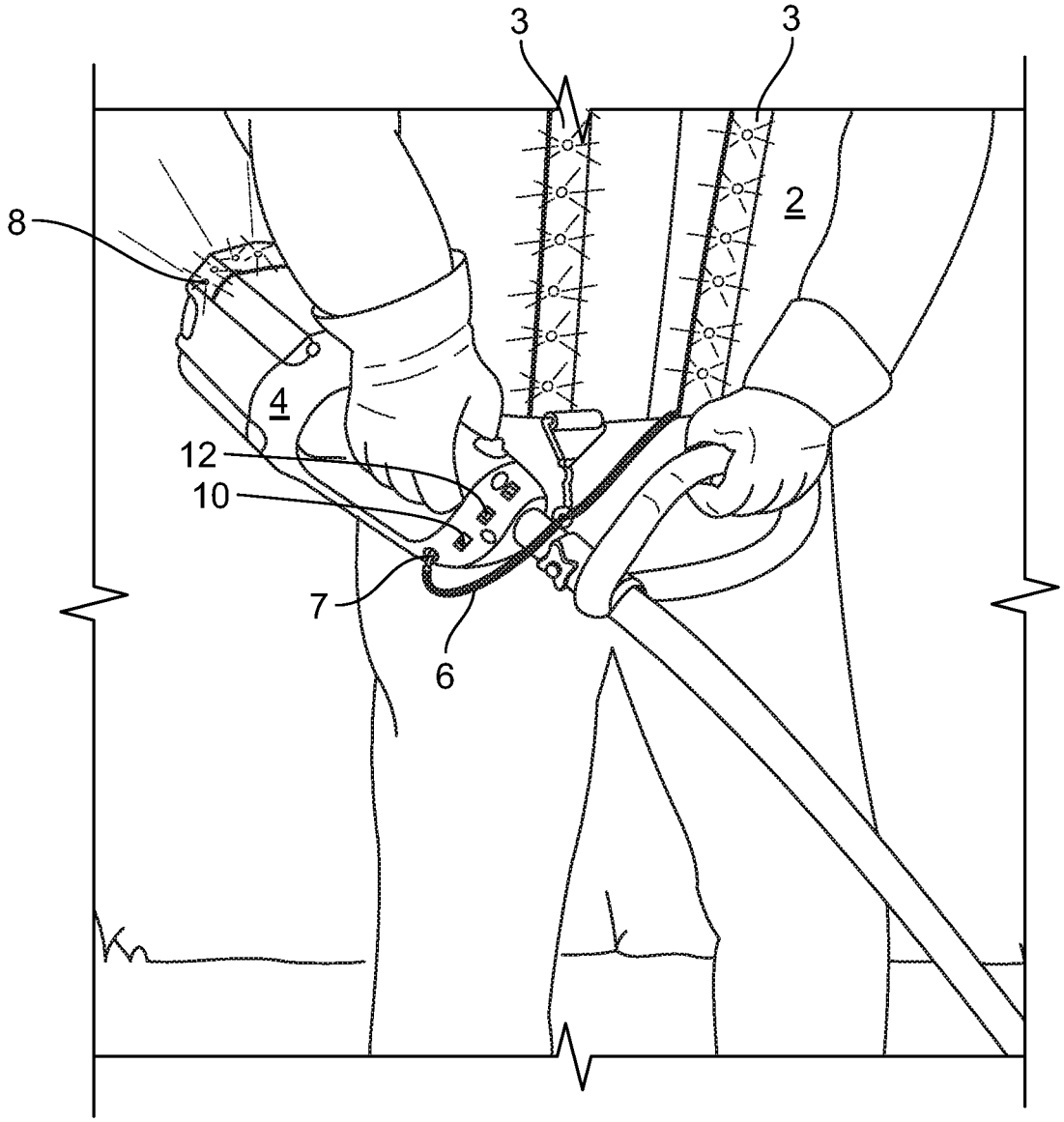
FIG. 6 illustrates a close-up view of a housing of a piece of equipment showing the inlet ports where the vest connects to the piece of equipment.

Referring to FIG. 6, a close-up view of the ports located on a housing of a piece of equipment is shown. The piece of equipment 4 will have at least one style of port 10/12. The port 10/12 corresponds to the plug 7 attached to the lighted vest 2 by cord 6.

In some embodiments, the piece of equipment will have multiple styles of ports. For example, one piece of equipment 4 will have both a USB port 10 and a two-prong port 12.

Figure 7:
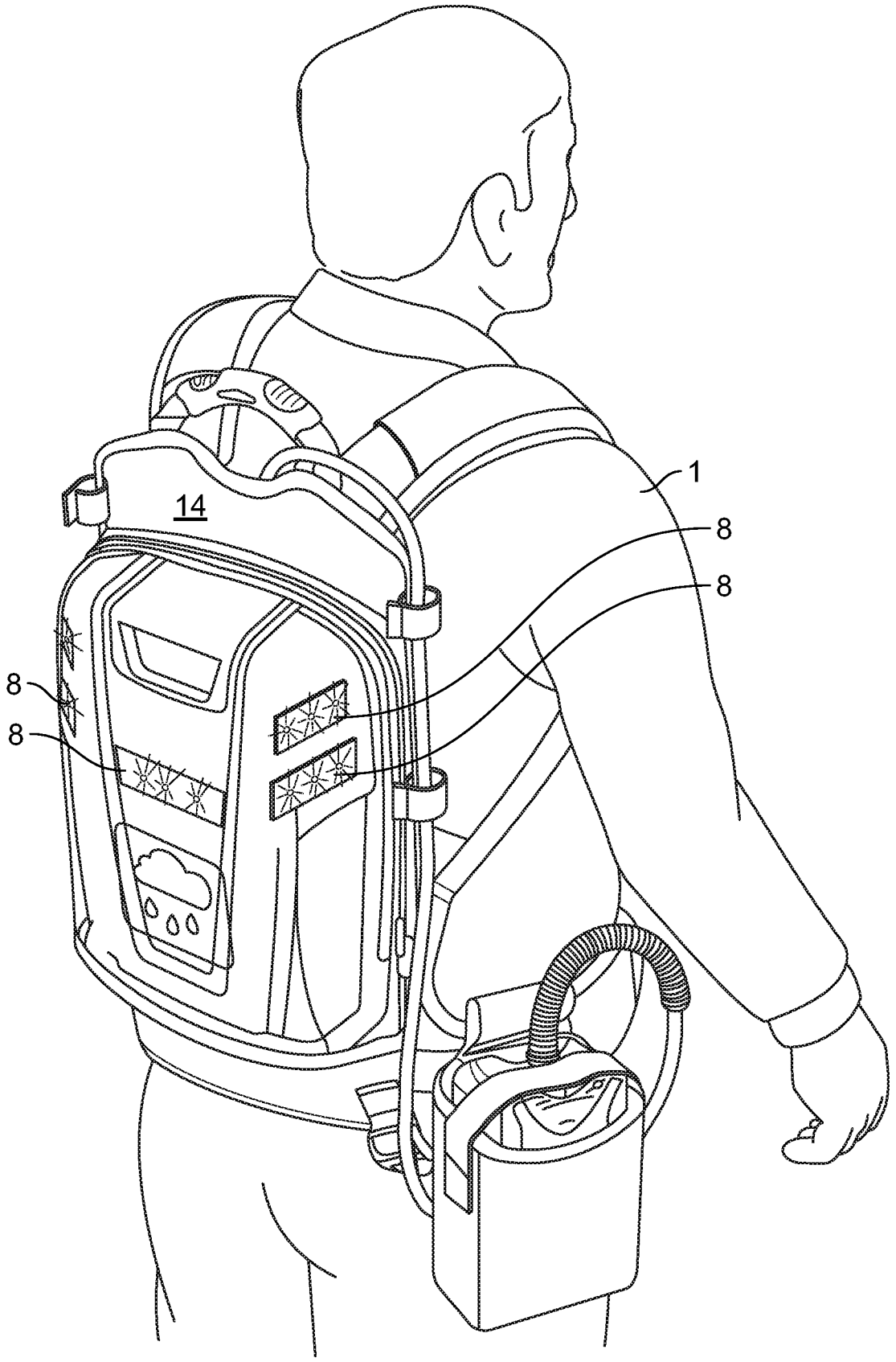
FIG. 7 illustrates a backpack for use with outdoor power equipment having built-in lighting elements.

Referring to FIG. 7, a backpack for use with outdoor equipment is shown. The backpack 14 worn by user 1 is typically seen in use with blowers but can be used with other equipment. The backpack 14 may be a blower with internal motor, or a battery for use with electric tools.

The backpack 14 has lights 8 on the back and sides. These lights 8, when coupled with lights 8 on a piece of equipment 4 (not shown) provide 360 degrees of visibility around both the user 1 and the piece of equipment 4. The combination of the backpack 14 and equipment 4 both having lights 8 provides optimal range of illumination around an area. This in turn provides clear outlines of a work area to be avoided by passersby or other workers.

Figure 8:
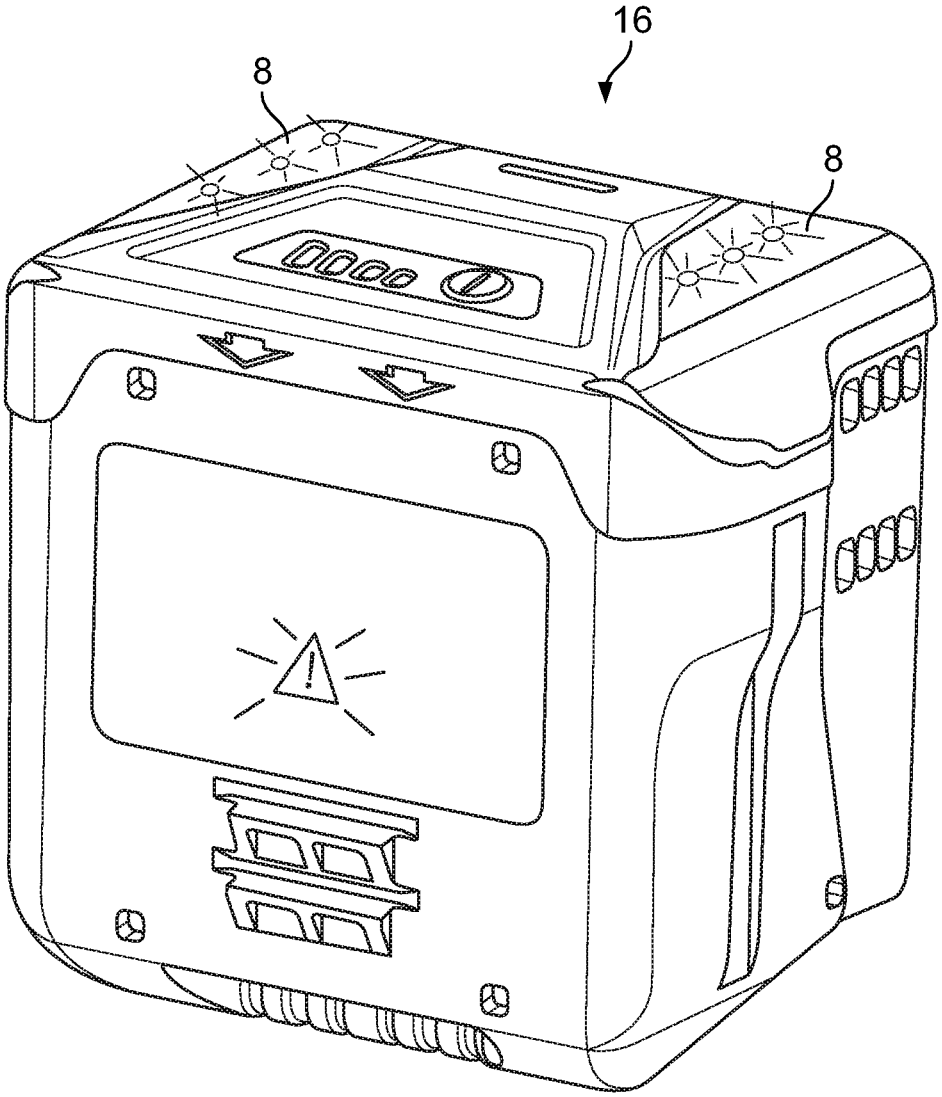
FIG. 8 illustrates a battery pack with built-in lighting elements.

Referring to FIG. 8, a battery pack for use with battery powered tools is shown with built-in lights. In another embodiment of safety system, a battery pack 16 that fits on a line of tools includes one or more lighting elements 8. The benefit of lighting elements on a battery pack 16 is that a new line of tools need not be created with lights. A user is able to acquire a new battery pack 16 and will be able to increase safety during use of all battery powered tools that he or she already owns.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction, and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A 360-degree visibility safety lighting system for handheld power tools, the safety lighting system comprising:

a safety light, the safety light built into a housing on a power tool;

a vest, the vest having:

a plurality of lights, and a cord, the cord terminating in a plug;

wherein the plug inserts into a port on the housing of the power tool thereby drawing power from the power tool to power the plurality of lights.

2. The safety lighting system of claim 1, wherein:

the power tool is only operable when the cord is plugged into the power tool;

whereby the power tool deactivates when the cord is no longer plugged into the power tool.

3. The safety lighting system of claim 1, wherein:

the power tool is only operable when the cord is plugged into the power tool;

whereby the power tool deactivates when the cord is no longer plugged into the power tool.

4. The safety lighting system of claim 1, further comprising:

a support strap, the support strap including:

a plurality of lights, the plurality of lights running around the support strap, and a cord, the cord terminating in a plug;

wherein the plug inserts into a port on the housing of the power tool thereby drawing power from the power tool to power the plurality of lights; and whereby the support strap is worn over a shoulder and across a chest of a user, allowing the support strap to serve both as a source of illumination and a physical support for the power tool.

5. A 360-degree visibility safety lighting system for handheld power tools, the safety lighting system comprising:

a safety light, the safety light built into a housing on a power tool:

a support strap, the support strap including:

a plurality of lights, the plurality of lights running around the support strap, and a cord, the cord terminating in a plug;

wherein the plug inserts into a port on the housing of the power tool thereby drawing power from the power tool to power the plurality of lights; and whereby the support strap is worn over a shoulder and across a chest of a user, allowing the support strap to serve both as a source of illumination and a physical support for the power tool.

* * * * *